US008424352B2

(12) United States Patent
Jung et al.

(10) Patent No.: US 8,424,352 B2
(45) Date of Patent: Apr. 23, 2013

(54) APPARATUS AND METHOD FOR MANUFACTURING BARREL COIL SPRING

(75) Inventors: Chan-Gi Jung, Incheon (KR); Soon-Sam Hong, Changwon (KR)

(73) Assignee: Dae Won Kang Up Co., Ltd. (KR)

( * ) Notice: Subject to any disclaimer, the term of this patent is extended or adjusted under 35 U.S.C. 154(b) by 323 days.

(21) Appl. No.: 12/742,703

(22) PCT Filed: Mar. 18, 2008

(86) PCT No.: PCT/KR2008/001512

§ 371 (c)(1), (2), (4) Date: May 13, 2010

(87) PCT Pub. No.: WO2009/082059

PCT Pub. Date: Jul. 2, 2009

(65) Prior Publication Data

US 2010/0243098 A1 Sep. 30, 2010

(30) Foreign Application Priority Data

Dec. 20, 2007 (KR) ..... 10-2007-0134194

(51) Int. Cl.
*B21F 3/04* (2006.01)

(52) U.S. Cl.
USPC ..... 72/145; 72/371; 72/138; 72/142; 140/103

(58) Field of Classification Search ..... 72/135, 72/137, 138, 139, 141, 142, 144, 145, 371; 29/33 F; 140/89, 103, 124
See application file for complete search history.

(56) References Cited

U.S. PATENT DOCUMENTS

| | | | | | |
|---|---|---|---|---|---|
| 4,424,695 | A | * | 1/1984 | Kirchhoff et al. | 72/128 |
| 4,571,973 | A | * | 2/1986 | Morita | 72/137 |
| 4,576,028 | A | * | 3/1986 | Morita | 72/143 |
| 4,622,839 | A | * | 11/1986 | Sasaki et al. | 72/138 |
| 4,945,744 | A | * | 8/1990 | Lienert | 72/137 |

FOREIGN PATENT DOCUMENTS

| | | | |
|---|---|---|---|
| JP | 56-131034 | | 10/1981 |
| JP | 56131034 | A * | 10/1981 |
| JP | 02070342 | | 3/1990 |
| JP | 2002-143964 | | 5/2002 |
| JP | 2008114263 | | 5/2008 |
| WO | WO 2008035833 | A1 * | 3/2008 |

OTHER PUBLICATIONS

International Search Report—PCT/KR2008/001512 dated Sep. 11, 2008.
Written Opinion—PCT/KR2008/001512 dated Sep. 11, 2008.
Korean Office Action—Korean Application No. 10-2007-0134194 issued on Apr. 2, 2010, citing JP02070342, JP2002143964, JP2008114263 and JP56131034.

* cited by examiner

*Primary Examiner* — Edward Tolan
*Assistant Examiner* — Lawrence J Averick
(74) *Attorney, Agent, or Firm* — Cantor Colburn LLP

(57) ABSTRACT

An apparatus and method for manufacturing a barrel coil spring make it possible to coil opposite sides of a spring material at the same time so as to considerably reduce manufacturing processing, thereby remarkably reducing the time required to manufacture the coil barrel spring, thus improving productivity.

17 Claims, 8 Drawing Sheets

APPARATUS AND METHOD FOR MANUFACTURING BARREL COIL SPRING

TECHNICAL FIELD

The present invention relates, in general, to an apparatus and method for manufacturing a barrel coil spring, and more particularly, to an apparatus and method for manufacturing a barrel coil spring, capable of coiling opposite sides of a spring material at the same time so as to considerably reduce the number of manufacturing processes, thereby remarkably reducing the time required to manufacture the coil barrel spring and thus improving productivity.

BACKGROUND ART

Now, the background art will be described.

FIG. 1 is a front view illustrating a typical barrel coil spring.

As illustrated in FIG. 1, the barrel coil spring 1, which is, for example, a miniblock spring, which has a smaller diameter at opposite ends thereof than in the middle thereof, a side load coil spring, which has a gradually reduced diameter from the middle to the opposite ends thereof, or the like, has a smaller diameter at opposite ends thereof than in the middle thereof. Thus, when a spring material is coiled from one end thereof to the other end thereof at one time using a coiler, it cannot be removed from the coiler. For this reason, the spring material is coiled once from one end thereof to the middle thereof using the coiler, and then from the other end thereof to the middle thereof once in a separate subsequent step. Then, the middle part of the coiled spring material is pressed using a bending press. Thereby, the barrel coil spring is manufactured.

The process of manufacturing such a barrel coil spring will be described below in detail with reference to FIG. 2.

FIG. 2 is a diagram explaining the conventional process of manufacturing a barrel coil spring.

As illustrated in FIG. 2, a spring material 2 is coiled from one end thereof to the middle thereof using a coiler 3. Thereby, one side of the spring material 2 is coiled first.

In this manner, after one side of the spring material 2 is coiled first, the spring material 2 is separated from the coiler 3. Next, the coiled spring material 2 is coiled from the other end thereof to the middle thereof using the coiler 3 so as to be coiled in the opposite direction relative to the first side thereof. Thereby, the other side of the spring material 2 is coiled.

As described above, after the opposite sides of the spring material 2 are coiled such that the directions thereof are opposite each other, the coiled spring material is separated from the coiler 3, and the uncoiled middle part of the spring material 2 is pressed using a bending press 4. Thereby, the barrel coil spring 1 is manufactured in a desired shape.

However, when the barrel coil spring 1 is manufactured using this method, the spring material 2 must be coiled twice at the opposite sides thereof. As such, the number of working processes is increased, and it takes a lot of time to manufacture the barrel coil spring 1. As a result, the productivity of the barrel coil spring is remarkably reduced.

DISCLOSURE OF INVENTION

Technical Problem

Accordingly, the present invention has been made in an effort to solve the problems occurring in the related art, and an object of the present invention is to provide an apparatus and method for manufacturing a barrel coil spring, capable of coiling opposite sides of a spring material at the same time so as to considerably reduce the number of manufacturing processes, thereby remarkably reducing the time required to manufacture the coil barrel spring to improve productivity.

Technical Solution

In order to achieve the above object, according to an aspect of the present invention, there is provided an apparatus for manufacturing a barrel coil spring, which comprises: a pair of machine frames, which are installed on the rear and front sides of the upper surface of a base frame, and include linear motion guides on the opposite sides of upper surfaces thereof; a pair of forward and backward transfer units, which are installed on the upper surfaces of the machine frames such that first sides thereof are coupled to upper surfaces of the linear motion guides, which are installed on the opposite sides of the upper surfaces of the machine frames, and such that the first sides thereof move along the linear motion guides; a pair of coilers, which are installed on upper ends of the forward and backward transfer units, cooperate with first sides of the forward and backward transfer units, moving along the linear motion guides to thereby move from the rear and front sides toward the middle part of the base frame, are turned while moving from the first side toward the second side of the base frame, or from the second side toward the first side of the base frame to thereby coil opposite sides of a spring material at the same time; and a pair of guides, which are installed on the upper surface of the forward and backward transfer units so as to be located beside the coilers, adjust the pitch and diameter of the spring material coiled by the coilers while moving in cooperation with the coilers, and support the spring material.

According to an aspect of the present invention, the pair of machine frames is coupled to a pair of hinges protruding from the middle part of the upper surface of the base frame at first ends of first sides thereof, is supported on upper ends of multiple supports installed on opposite sides of the upper surface of the base frame on lower surfaces of second sides thereof, and is rotated around the hinges.

According to an aspect of the present invention, the pair of machine frames is rotated around the hinges by the operation of machine frame rotating units, which are coupled to the middle part of the upper surface of the base frame at first ends thereof and to the middle parts of the lower surfaces of the machine frames at second ends thereof.

According to an aspect of the present invention, the machine frame rotating units comprise: stationary blocks, which are installed on the middle part of the upper surface of the base frame; rotating motors, which are hinged to first sides of the stationary blocks; ball screws, which are coupled with the rotating motors at first ends thereof, and are rotated by the operation of the rotating motors; and movable blocks, which are installed on the middle parts of the lower surfaces of the machine frames, are screwed into ball screws, and move along the ball screws.

According to an aspect of the present invention, the pair of forward and backward transfer units comprises: forward and backward transfer motors, which are installed on the middle parts of the upper surfaces of the machine frames; ball screws, which are coupled with the forward and backward transfer motors on first ends thereof, and are rotated by the forward and backward transfer motors; and forward and backward transfer plates, which are installed on the upper surfaces of the linear motion guides such that lower ends thereof are coupled with the second ends of the ball screws, and move along the linear motion guides while the ball screws are rotated.

According to an aspect of the present invention, the pair of coilers comprises: lower ball spline shafts, which are rotatably fitted into upper ends of bearing blocks installed on the upper surfaces of the forward and backward transfer units; mandrels, which are fitted around first ends of the lower ball spline shafts at second ends thereof; upper ball spline shafts, which are slidably fastened to middle parts of stationary blocks installed on upper ends of cases so as to be located above the lower ball spline shafts; pitch adjusting units, which are rotatably fitted into lower ends of the bearing blocks at first ends thereof, are fixed to the cases installed on the upper surfaces of the forward and backward transfer units at the second ends thereof, and are coupled with second ends of the lower ball spline shafts at middle parts thereof; mandrel rotating units, which are installed on the upper surfaces of the forward and backward transfer units, are coupled with middle parts of the lower ball spline shafts at first ends thereof, and rotate the lower ball spline shafts and the mandrels; mandrel spacing adjusting units, which are coupled with the first ends of the upper ball spline shafts at first ends thereof, and are installed on the second ends of the upper ball spline shafts so as to be coupled with the second ends of the mandrels below second ends thereof; and spring material fixing units, which are installed below the first ends of the mandrel spacing adjusting units so that the first ends of the mandrels can be inserted thereinto and coupled thereto.

According to an aspect of the present invention, the pitch adjusting units comprise: ball screws, which are rotatably fitted into lower ends of the bearing blocks at first ends thereof; pitch adjusting motors, which are coupled with second ends of the ball screws to rotate the ball screws; and guide blocks, which are screwed to the ball screws at lower ends thereof, are coupled with the second ends of the lower ball spline shafts at upper ends thereof, and move along the ball screws by means of the operation of the pitch adjusting motors to thereby transfer the upper ball spline shafts, the lower ball spline shafts, and the mandrels.

According to an aspect of the present invention, the mandrel rotating units comprise: timing pulleys, which are installed on the lower ball spline shafts; and spindle rotating motors, which are installed on the upper surfaces of the forward and backward transfer units so as to be coupled with the timing pulleys via timing belts and rotate the timing pulleys, the lower ball spline shafts, and the mandrels.

According to an aspect of the present invention, the mandrel spacing adjusting units comprise: stationary blocks, which are installed on the first ends of the upper ball spline shafts; movable blocks, which are installed on the upper ball spline shafts so as to be movable in forward and backward directions, and are coupled to the second ends of the mandrels at lower ends thereof; and spacing adjusting cylinders, which are coupled to the stationary blocks at first ends thereof and to the movable blocks at second ends thereof.

According to an aspect of the present invention, the stationary blocks are equipped with end forming cylinders on first sides thereof, which form the spring material while pressing the ends of the spring material.

According to an aspect of the present invention, the spring material fixing units comprise: bodies, which are installed on lower ends of the stationary blocks of the mandrel spacing adjusting units; coupling blocks, which are rotatably installed on first sides of the bodies, and are provided with fastening recesses, into and to which the first ends of the mandrels are inserted and fastened, in middle parts of second sides of the bodies; chucking cylinders, which are inserted into and mounted in the coupling blocks such that first ends thereof protrude from middle parts of lower surfaces of the coupling blocks; and chucking jaws, which are mounted on lower ends of the chucking cylinders, and fix the ends of the spring material interposed between the mandrels and the coupling blocks.

According to an aspect of the present invention, the coupling blocks further include fixing recesses in outer circumferences thereof, and the bodies are equipped with mandrel stopper cylinders, first ends of which are selectively inserted into the fixing recesses, at lower ends thereof.

According to an aspect of the present invention, the pair of guides comprises: linear motion guides, which are installed on the upper surface of the forward and backward transfer units so as to be located near first sides of the pair of coilers; transfer plates, which are installed on upper surfaces of the linear motion guides, and move along the linear motion guides; spring material supports, which are mounted on first sides of the transfer plates; spring material loading cylinders, which are installed on the upper surfaces of the forward and backward transfer units so as to be coupled with middle parts of lower ends of the transfer plates and transfer the transfer plates and the spring material supports along the linear motion guides; leftward and rightward transfer blocks, which are slidably fastened to the upper surfaces of the transfer plates at first sides thereof; pitch adjusting cylinders, which are coupled to middle parts of upper surfaces of the transfer plates at first ends thereof and to the second sides of the leftward and rightward transfer blocks at second ends thereof, and transfer the leftward and rightward transfer blocks; upward and downward transfer blocks, which are slidably fastened to upper ends of the second sides of the leftward and rightward transfer blocks; first rotating shafts, which are rotatably installed on the upward and downward transfer blocks; second rotating shafts, which are rotatably installed on upper ends of the first rotating shafts at an incline in an upward direction; guide rollers, which are rotatably installed on upper ends of the second rotating shafts; and spring diameter adjusting cylinders, which are coupled to lower ends of the second sides of the leftward and rightward transfer blocks at lower ends thereof and to lower ends of the upward and downward transfer blocks at upper ends thereof.

According to another aspect of the present invention, there is provided a method for manufacturing a barrel coil spring, which comprises: a spring material loading step of transferring a heated spring material using a loader to load the spring material on guide rollers of the guides and the upper ends of the spring material supports; a spring material fixing step of operating forward and backward transfer units to move a pair of coilers and the guides, which are installed on upper surfaces of the forward and backward transfer units, toward the middle part of a base frame so as to cause opposite ends of the spring material to be inserted between a pair of mandrels and a pair of spring material fixing units, and operating chucking cylinders to lift chucking jaws so as to fix the opposite ends of the spring material between the mandrels and the spring material fixing units; a spring material coiling step of further transferring the coilers and the guides toward the middle part of the base frame by means of the forward and backward transfer units, and operating the coilers and the guides so as to correspond to the diameter and pitch of the coil spring to be manufactured to thereby coil opposite sides of the spring material around the mandrels at the same time; and a spring material pressing step of operating spacing adjusting cylinders and pitch adjusting motors to cause the mandrels to escape from the spring material whose opposite sides have been coiled, and pressing a middle part of the spring material whose opposite sides have been coiled, using a bending press to form the coil spring into a desired shape.

According to another aspect of the present invention, the spring material coiling step includes operating a pair of machine frame rotating units to cause the machine frames to be simultaneously rotated around hinges in one direction such that the coilers and the guides are rotated in one direction to coil the opposite sides of the spring material at the same time.

According to another aspect of the present invention, in the spring material coiling step, mandrel rotating units are operated to rotate lower ball spline shafts and the mandrels thereby coiling the opposite sides of the spring material around the mandrels at the same time, and pitch adjusting units are operated to transfer upper ball spline shafts, the lower ball spline shafts, and the spring material fixing units toward a second or first side of the base frame, so that the coilers adjust the pitch of the spring material coiled around the mandrels.

According to another aspect of the present invention, in the spring material coiling step, leftward and rightward transfer blocks are operated by pitch adjusting cylinders, and the guide rollers, supporting the spring material, move toward the second or first side of the base frame, so that the guides adjust the pitch of the spring material coiled around the mandrels, and spring diameter adjusting cylinders are operated to move the guide rollers in upward and downward directions, so that the guides adjust the diameter of the spring material coiled around the mandrels.

As described above, according to the present invention, the apparatus and method for manufacturing a barrel coil spring enables the opposite sides of the spring material to be simultaneously coiled using a coiler, so that they can considerably reduce the number of processes and time required to manufacture the coil barrel spring, thus improving productivity.

DESCRIPTION OF SYMBOLS OF THE MAIN PARTS IN THE DRAWINGS

Figure 1:
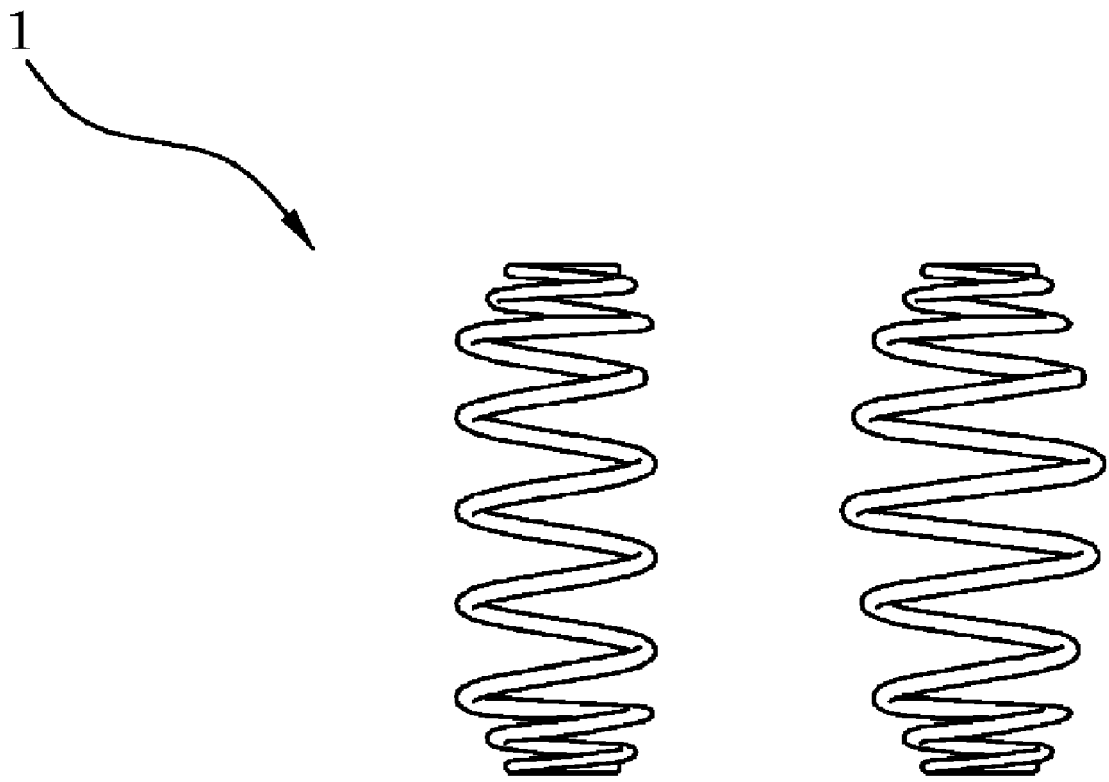
FIG. 1 is a front view illustrating a typical barrel coil spring.
Figure 2:
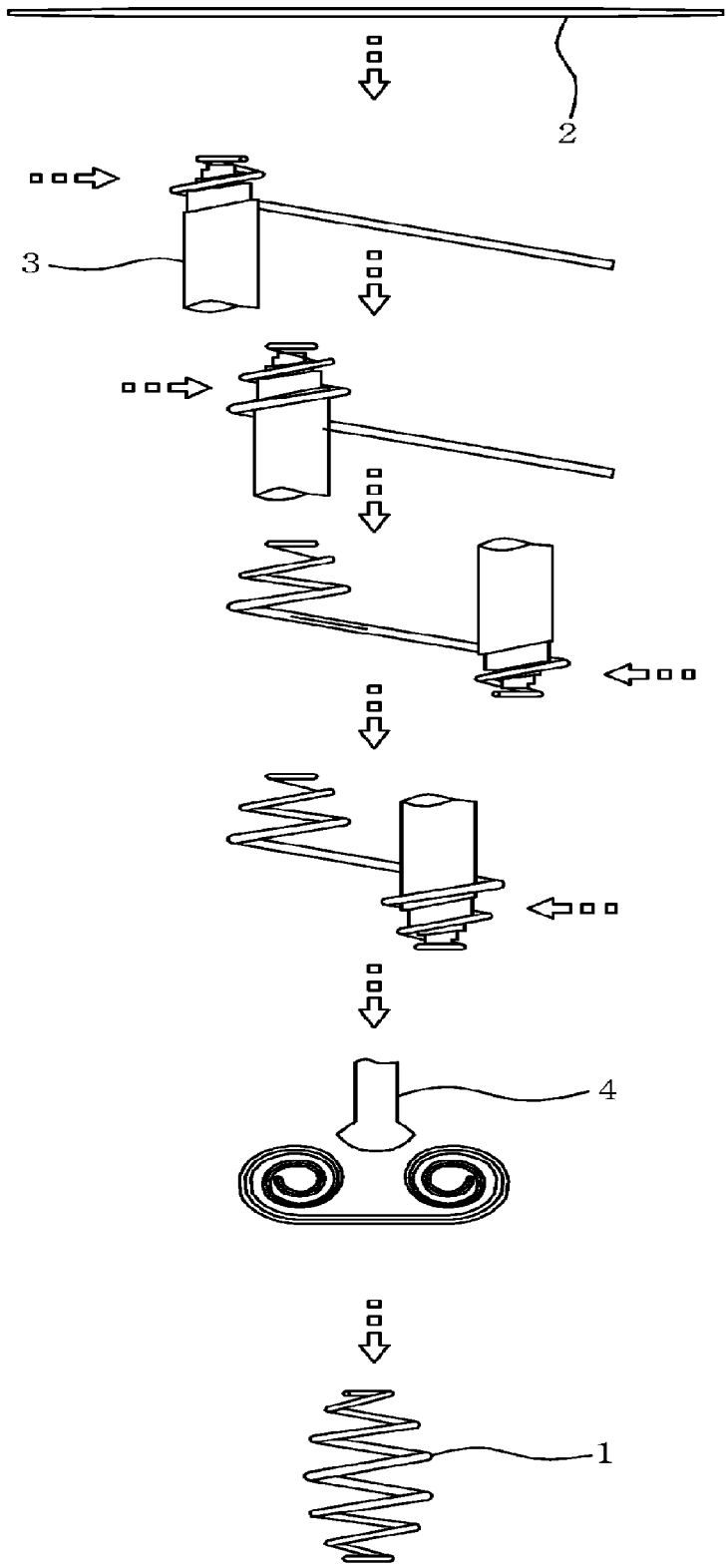
FIG. 2 is a diagram explaining a conventional process of manufacturing a barrel coil spring.

1: apparatus for manufacturing a barrel coil spring
10: base frame
11 and 11': machine frames
12 and 12': forward and backward transfer units
13 and 13': coilers
14 and 14': guides
15 and 15': machine frame rotating units

MODE FOR THE INVENTION

Reference will now be made in greater detail to an exemplary embodiment of the invention, an example of which is illustrated in the accompanying drawings.

Figure 3:
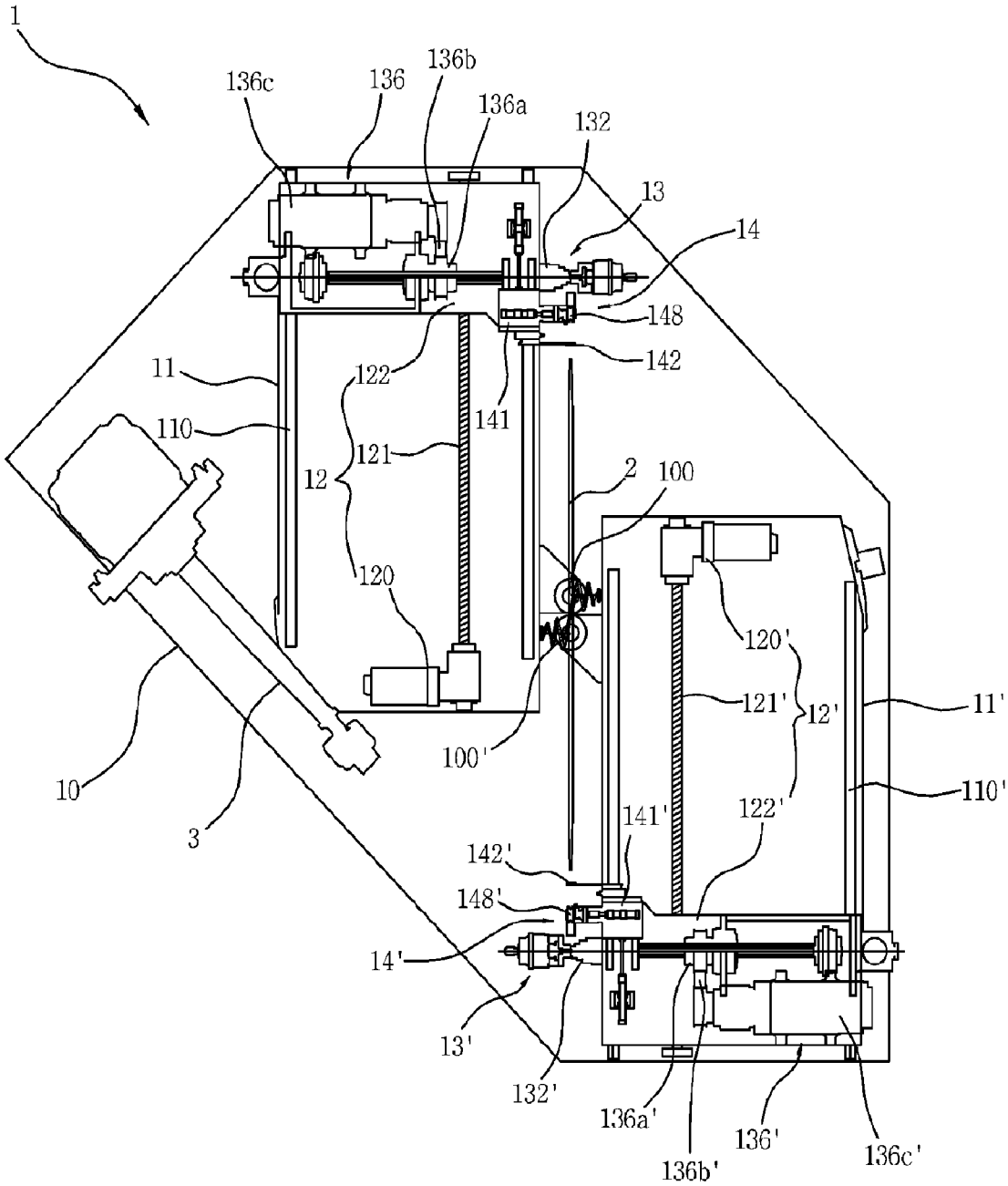
FIG. 3 is a front view illustrating an apparatus for manufacturing a barrel coil spring according to an embodiment of the present invention.
Figure 4:
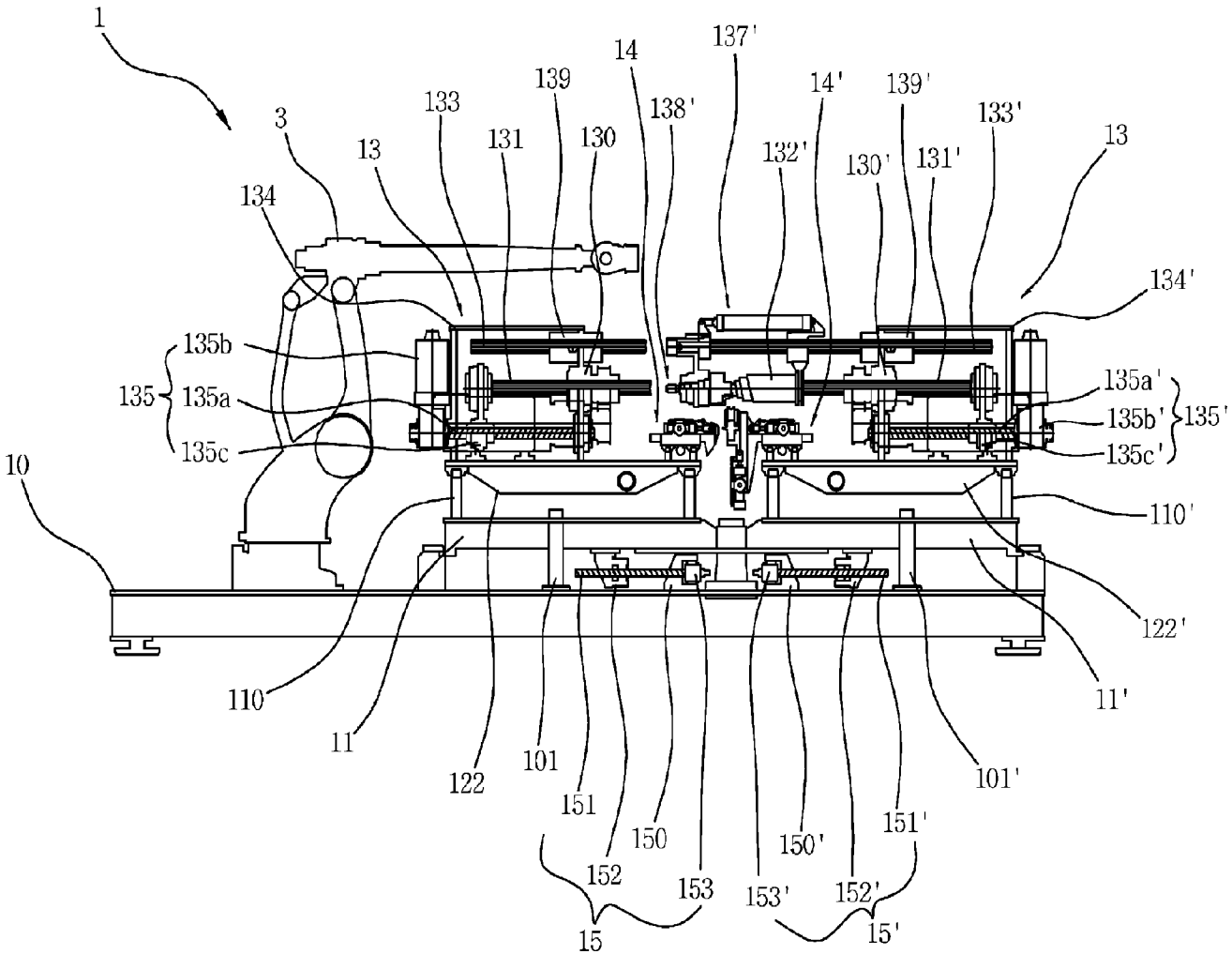
FIG. 4 is a top plan view illustrating an apparatus for manufacturing a barrel coil spring according to an embodiment of the present invention.
Figure 5:
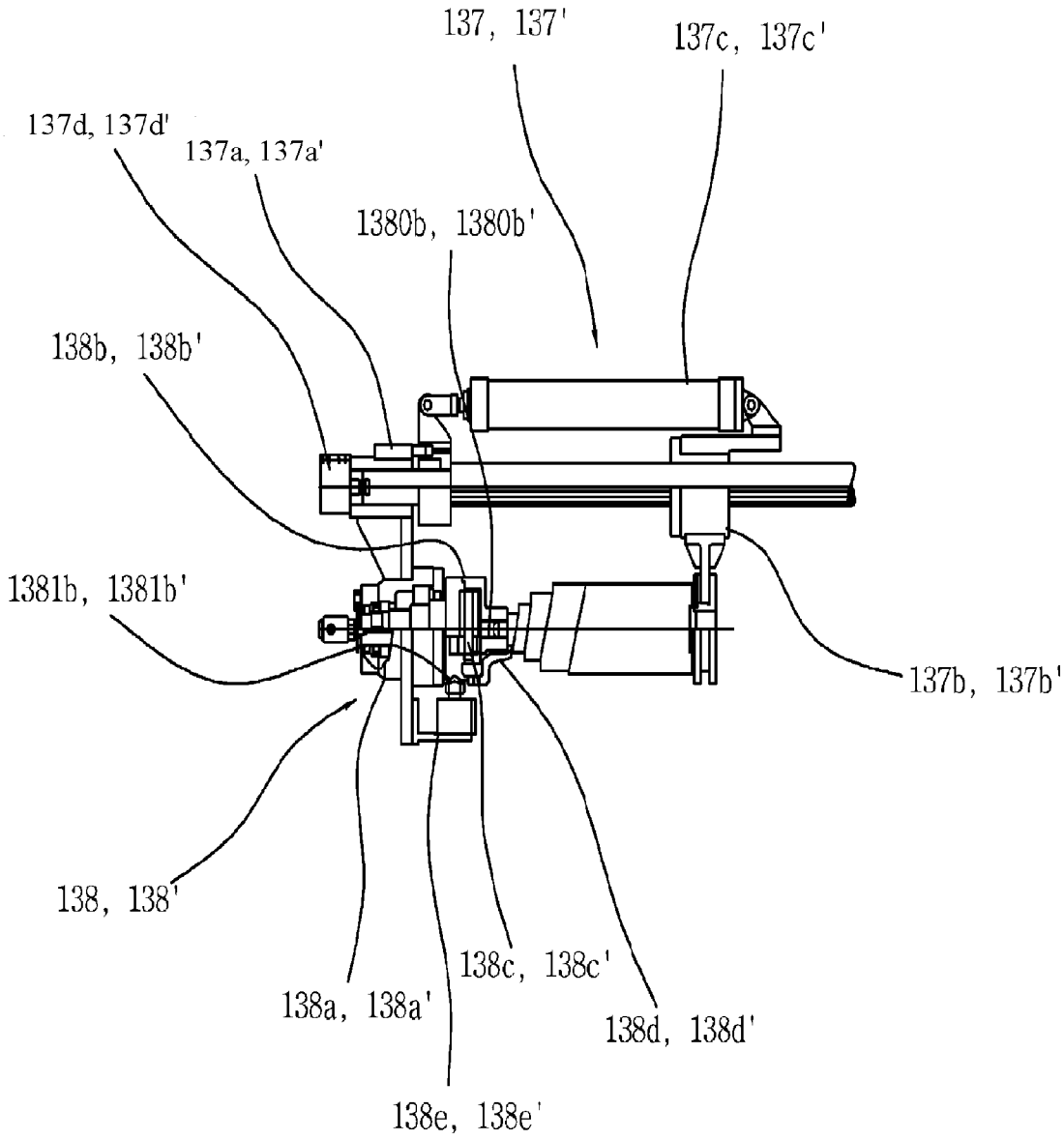
FIG. 5 is a detailed view illustrating a spring material fixing unit and a mandrel spacing adjusting unit according to an embodiment of the present invention.
Figure 6:
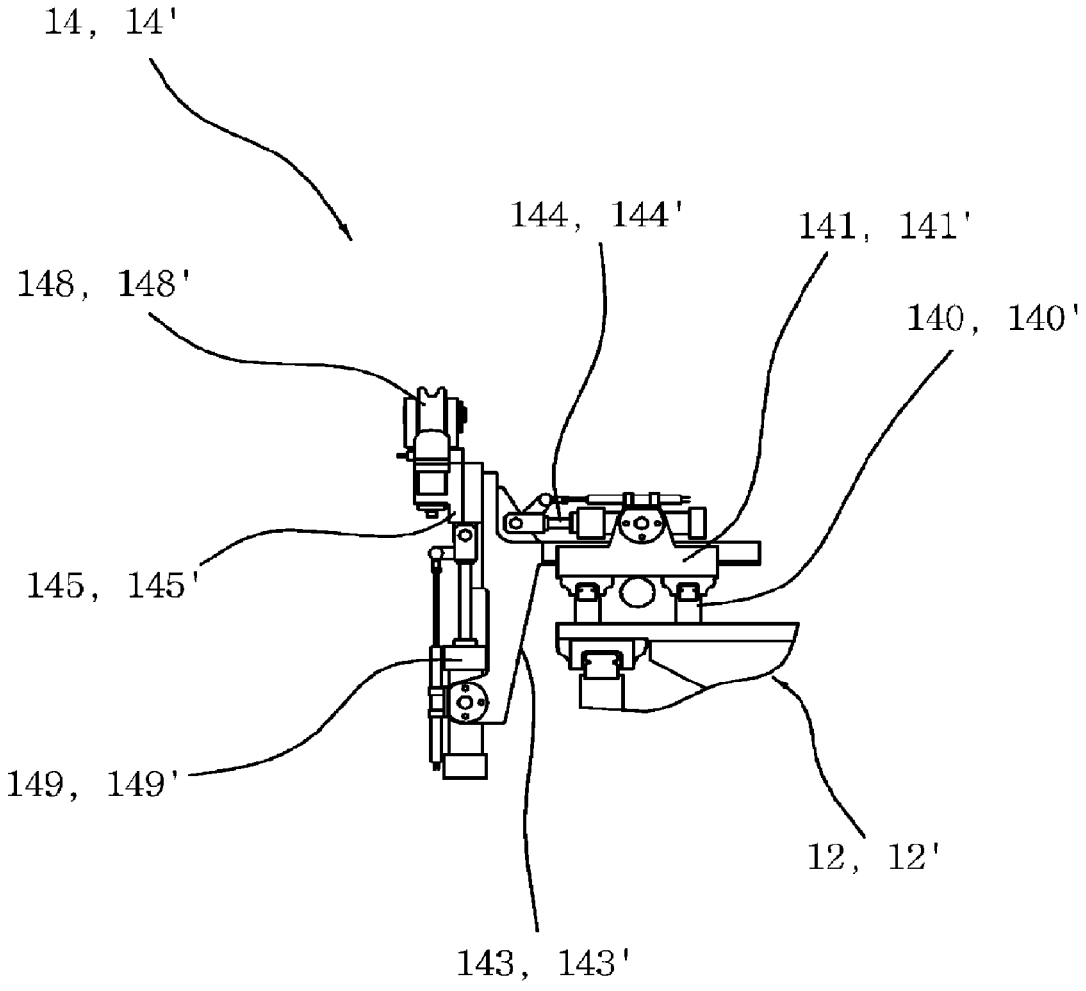
FIG. 6 is a detailed view illustrating a guide according to an embodiment of the present invention.
Figure 7:
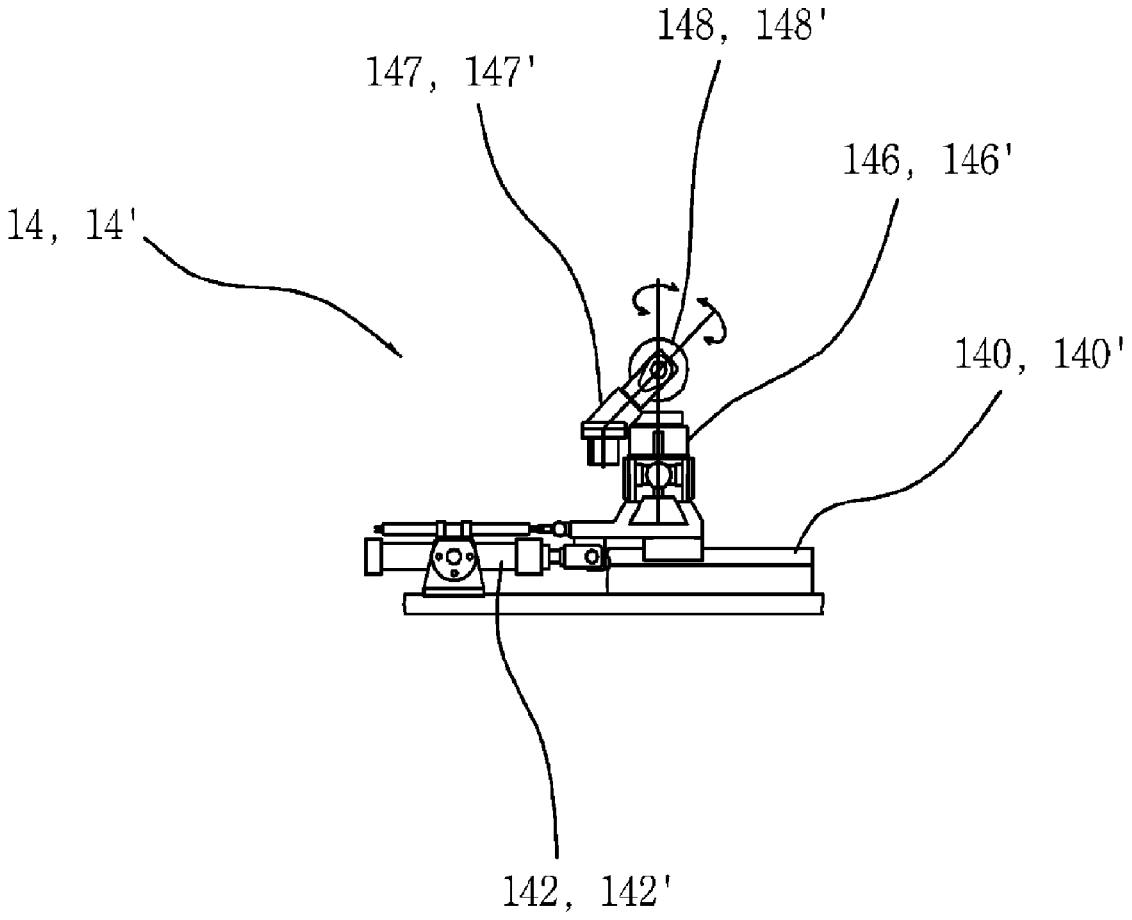
FIG. 7 is a side view of FIG. 6.

FIG. 3 is a front view illustrating an apparatus for manufacturing a barrel coil spring according to an embodiment of the present invention. FIG. 4 is a top plan view illustrating an apparatus for manufacturing a barrel coil spring according to an embodiment of the present invention. FIG. 5 is a detailed view illustrating a spring material fixing unit and a mandrel spacing adjusting unit according to an embodiment of the present invention. FIG. 6 is a detailed view illustrating a guide according to an embodiment of the present invention. FIG. 7 is a side view of FIG. 6.

Referring to FIGS. 3 through 7, the apparatus 1 for manufacturing a barrel coil spring according to an embodiment of the present invention comprises a pair of machine frames 11 and 11', a pair of forward and backward transfer units 12 and 12', a pair of coilers 13 and 13', and a pair of guides 14 and 14'.

The pair of machine frames 11 and 11' of the apparatus 1 for manufacturing a barrel coil spring according to an embodiment of the present invention is installed on rear and front sides of the upper surface of a base frame 10. A pair of linear motion (LM) guides 110 and a pair of LM guides 110' is installed on respective opposite sides of upper surfaces of the pair of machine frames.

The pair of forward and backward transfer units 12 and 12' is installed on the upper surfaces of the pair of machine frames 11 and 11' such that first sides thereof are coupled to upper surfaces of the LM guides 110 and 110', which are installed on the opposite ends of the upper surfaces of the pair of machine frames 11 and 11'. Thus, the first sides of the forward and backward transfer units 12 and 12' move along the LM guides 110 and 110'.

The pair of forward and backward transfer units 12 and 12' comprises forward and backward transfer motors 120 and 120', ball screws 121 and 121', and forward and backward transfer plates 122 and 122'.

The forward and backward transfer motors 120 and 120' of the forward and backward transfer units 12 and 12', configured as described above, are installed on the middle parts of the upper surfaces of the machine frames 11 and 11', respectively.

The ball screws 121 and 121' are coupled with the forward and backward transfer motors 120 and 120' on first ends thereof, and are rotated by the forward and backward transfer motors 120 and 120'.

The forward and backward transfer plates 122 and 122' are installed on the upper surfaces of the LM guides 110 and 110' such that lower ends thereof are coupled with the second ends of the ball screws 121 and 121'. Thus, as the ball screws 121 and 121' are rotated, the forward and backward transfer plates 122 and 122' move along the LM guides 110 and 110'.

The pair of coilers 13 and 13' is installed on upper ends of the forward and backward transfer plates 122 and 122' of the forward and backward transfer units 12 and 12'. The pair of coilers 13 and 13' cooperates with first ends of the forward and backward transfer units 12 and 12' moving along the LM guides 110 and 110', thereby moving from the first and second sides to the middle of the base frame 10. At this time, the pair of coilers 13 and 13' turns while moving from the first side toward the second side of the base frame 10, or from the second side toward the first side of the base frame 10, thereby coiling opposite sides of a spring material 2 at the same time.

The pair of coilers 13 and 13' comprises lower ball spline shafts 131 and 131', mandrels 132 and 132', upper ball spline shafts 133 and 133', pitch adjusting units 135 and 135', mandrel rotating units 136 and 136', mandrel spacing adjusting units 137 and 137', and spring material fixing units 138 and 138'.

The lower ball spline shafts 131 and 131' of the pair of coilers 13 and 13', configured as described above, are rotatably fitted into upper ends of bearing blocks 130 and 130' installed on the upper surfaces of the forward and backward transfer units 12 and 12'.

The mandrels 132 and 132' are fitted around first ends of the lower ball spline shafts 131 and 131' at second ends thereof.

The upper ball spline shafts 133 and 133' are slidably fastened to the middle parts of stationary blocks 139 and 139', installed on upper ends of cases 134 and 134' so as to be located above the lower ball spline shafts 131 and 131'.

The pitch adjusting units 135 and 135' are rotatably fitted into lower ends of the bearing blocks 130 and 130' at first ends thereof, are fixed to the cases 134 and 134', installed on the upper surfaces of the forward and backward transfer units 12 and 12' at the second ends thereof, and are coupled with the second ends of the lower ball spline shafts 131 and 131' at the middle parts thereof.

The pitch adjusting units 135 and 135' comprise ball screws 135*a* and 135*a'*, first ends of which are rotatably fitted into lower ends of the bearing blocks 130 and 130', pitch adjusting motors 135*b* and 135*b'*, which are coupled with second ends of the ball screws 135*a* and 135*a'* so as to rotate the ball screws 135*a* and 135*a'*, and guide blocks 135*c* and 135*c'*, lower ends of which are screwed to the ball screws 135*a* and 135*a'*, and upper ends of which are coupled with the second ends of the lower ball spline shafts 131 and 131', and which move along the ball screws 135*a* and 135*a'* by means of the operation of the pitch adjusting motors 135*b* and 135*b'* to thereby displace the upper ball spline shafts 133 and 133', the lower ball spline shafts 131 and 131', and the mandrels 132 and 132'.

The mandrel rotating units 136 and 136' are installed on the upper surfaces of the forward and backward transfer units 12 and 12', are coupled with the middle parts of the lower ball spline shafts 131 and 131' at first ends thereof, and rotate the lower ball spline shafts 131 and 131' and the mandrels 132 and 132'.

The mandrel rotating units 136 and 136' comprise timing pulleys 136*a* and 136*a'*, which are installed on the lower ball spline shafts 131 and 131', and spindle rotating motors 136*c* and 136*c'*, which are installed on the upper surfaces of the forward and backward transfer units 12 and 12' so as to be coupled with the timing pulleys 136*a* and 136*a'* by timing belts 136*b* and 135*b'*, rotate the timing pulleys 136*a* and 136*a'*, the lower ball spline shafts 131 and 131', and the mandrels 132 and 132'.

The mandrel spacing adjusting units 137 and 137' are coupled with the first ends of the upper ball spline shafts 133 and 133' at first ends thereof, and are installed on the second ends of the upper ball spline shafts 133 and 133' so as to be coupled with the second ends of the mandrels 132 and 132' below second ends thereof.

The mandrel spacing adjusting units 137 and 137' comprise stationary blocks 137*a* and 137*a'*, which are installed on the first ends of the upper ball spline shafts 133 and 133', movable blocks 137*b* and 137*b'*, which are installed on the upper ball spline shafts 133 and 133' so as to be movable in forward and backward directions and are coupled to the second ends of the mandrels 132 and 132' at lower ends thereof, and spacing adjusting cylinders 137*c* and 137*c'*, which are coupled to the stationary blocks 137*a* and 137*a'* at first ends thereof and to the movable blocks 137*b* and 137*b'* at second ends thereof.

Alternatively, the stationary blocks 137*a* and 137*a'* may be equipped with end forming cylinders 137*d* and 137*d'* on first sides thereof, which form the spring material 2 while pressing the respective ends of the spring material.

The spring material fixing units 138 and 138' are installed below the first ends of the mandrel spacing adjusting units 137 and 137' so as to allow the first ends of the mandrels 132 and 132' to be inserted thereinto and coupled thereto.

The spring material fixing units 138 and 138' comprise bodies 138*a* and 138*a'*, which are installed on lower ends of the stationary blocks 137*a* and 137*a'* of the mandrel spacing adjusting units 137 and 137', coupling blocks 138*b* and 138*b'*, which are rotatably installed on first sides of the bodies 138*a* and 138*a'* and are provided with fastening recesses 1380*b* and 1380*b'*, into and to which the first ends of the mandrels 132 and 132' are inserted and fastened, in the middle parts of the second sides of the bodies 138*a* and 138*a'*, chucking cylinders 138*c* and 138*c'*, which are inserted into and mounted in the coupling blocks 138*b* and 138*b'* such that first ends thereof protrude from the middle parts of lower surfaces of the coupling blocks 138*b* and 138*b'*, and chucking jaws 138*d* and 138*d'*, which are mounted on lower ends of the chucking cylinders 138*c* and 138*c'* and fix the respective ends of the spring material 2, interposed between the mandrels 132 and 132' and the coupling blocks 138*b* and 138*b'*.

The coupling blocks 138*b* and 138*b'* are further provided with fixing recesses 1381*b* and 1381*b'* in the outer circumferences thereof. The bodies 138*a* and 138*a'* are further equipped with mandrel stopper cylinders 138*e* and 138*e'*, first ends of which are selectively inserted into the fixing recesses 1381*b* and 1381*b'*, at lower ends thereof.

The pair of guides 14 and 14' is installed on the upper surface of the forward and backward transfer units 12 and 12' so as to be located beside the pair of coilers 13 and 13', adjust the pitch and diameter of the spring material 2 coiled by the pair of coilers 13 and 13' while moving in cooperation with the pair of coilers 13 and 13', and support the spring material 2.

The pair of guides 14 and 14' comprises: LM guides 140 and 140', which are installed on the upper surface of the forward and backward transfer units 12 and 12' so as to be located near first sides of the pair of coilers 13 and 13'; transfer plates 141 and 141', which are installed on upper surfaces of the LM guides 140 and 140' and move along the LM guides 140 and 140'; spring material supports 142 and 142', which are mounted on first sides of the transfer plates 141 and 141'; spring material loading cylinders 142*a* and 142*a'*, which are installed on the upper surfaces of the forward and backward transfer units 12 and 12' so as to be coupled with the middle parts of lower ends of the transfer plates 141 and 141' and transfer the transfer plates 141 and 141' and the spring material supports 142 and 142' along the LM guides 140 and 140'; leftward and rightward transfer blocks 143 and 143', which are slidably fastened to the upper surfaces of the transfer plates 141 and 141' at first sides thereof; pitch adjusting cylinders 144 and 144', which are coupled to middle parts of upper surfaces of the transfer plates 141 and 141' at first ends thereof and to the second sides of the leftward and rightward transfer blocks 143 and 143' at second ends thereof and transfer the leftward and rightward transfer blocks 143 and 143'; upward and downward transfer blocks 145 and 145', which are slidably fastened to upper ends of the second sides of the leftward and rightward transfer blocks 143 and 143';

first rotating shafts 146 and 146', which are rotatably installed on the upward and downward transfer blocks 145 and 145'; second rotating shafts 147 and 147', which are rotatably installed on upper ends of the first rotating shafts 146 and 146' at an incline in an upward direction; guide rollers 148 and 148', which are rotatably installed on upper ends of the second rotating shafts 147 and 147'; and spring diameter adjusting cylinders 149 and 149', which are coupled to lower ends of the second sides of the leftward and rightward transfer blocks 143 and 143' at lower ends thereof and to lower ends of the upward and downward transfer blocks 145 and 145' at upper ends thereof.

Further, the pair of machine frames 11 and 11' is coupled to a pair of hinges 100 and 100' protruding from the middle part of the upper surface of the base frame 10 at first ends of first sides thereof, and is supported on upper ends of multiple supports 101 and 101' installed on opposite sides of the upper surface of the base frame 10 on lower surfaces of second sides thereof, so that they can be rotated around the hinges 100 and 100'.

Here, the pair of machine frames 11 and 11' is rotated around the hinges 100 and 100' by the operation of machine frame rotating units 15 and 15', which are coupled to the middle part of the upper surface of the base frame 10 at first ends thereof and to the middle parts of the lower surfaces of the machine frames 11 and 11' at second ends thereof.

The machine frame rotating units 15 and 15', which rotate the pair of machine frames 11 and 11' around the hinges 100 and 100', comprise stationary blocks 150 and 150', which are installed on the middle part of the upper surface of the base frame, rotating motors 153 and 153', which are hinged to first sides of the stationary blocks 150 and 150', ball screws 151 and 151', which are coupled with the rotating motors 153 and 153' at first ends thereof and are rotated by the operation of the rotating motors 153 and 153', and movable blocks 152 and 152', which are installed on the middle parts of the lower surfaces of the machine frames 11 and 11', are screwed to ball screws 151 and 151', and move along the ball screws 151 and 151'.

The method for manufacturing a barrel coil spring using the barrel coil spring manufacturing apparatus according to an embodiment of the present invention will be described below with reference to FIGS. 3 through 8.

Figure 8:
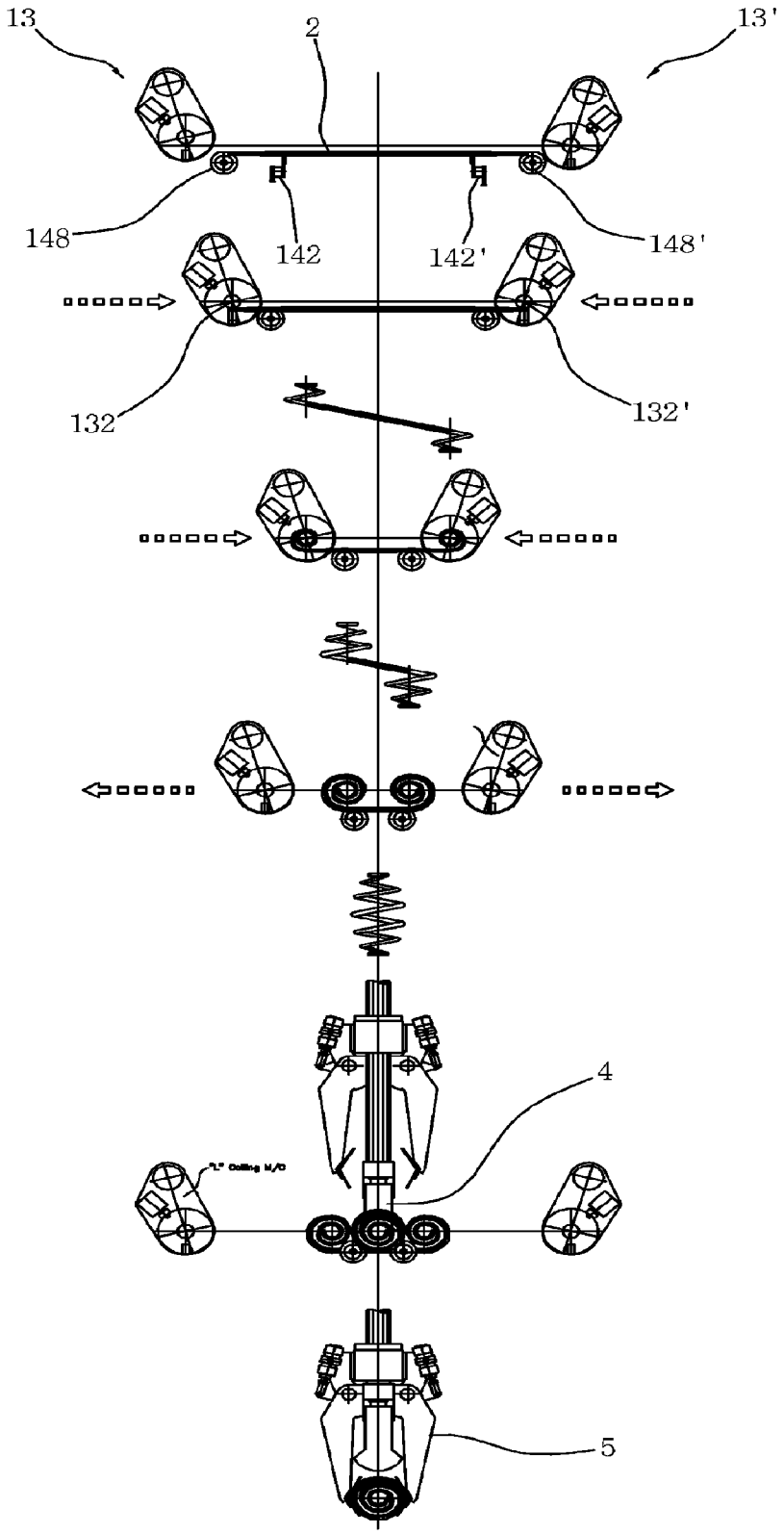
FIG. 8 is a diagram explaining a method of manufacturing a barrel coil spring using the barrel coil spring manufacturing apparatus according to an embodiment of the present invention.

FIG. 8 is a diagram explaining the method of manufacturing a barrel coil spring using the barrel coil spring manufacturing apparatus according to an embodiment of the present invention.

Referring to FIGS. 3 through 8, first, the spring material 2, which has been heated, is transferred by a loader 3, and then is loaded on the guide rollers 148 and 148' of the guides 14 and 14' and the upper ends of the spring material supports 142 and 142'.

Specifically, the spring material loading cylinders 142*a* and 142*a'* are operated to transfer the guides 14 and 14' such that the guide rollers 148 and 148' are located at opposite ends of the spring material 2, and then the spring material 2, transferred by the loader 3, is loaded on the guide rollers 148 and 148' and the upper ends of the spring material supports 142 and 142'.

As described above, after the spring material 2 is loaded on the guide rollers 148 and 148' and the upper ends of the spring material supports 142 and 142', the forward and backward transfer units 12 and 12' are operated to move the coilers 13 and 13' and the guides 14 and 14', which are installed on the upper surfaces of the forward and backward transfer units 12 and 12', toward the middle part of the base frame 10, so that the opposite ends of the spring material 2 are inserted between the mandrels 132 and 132' and the spring material fixing units 138 and 138'. Then, the chucking cylinders 138*c* and 138*c'* are operated to lift the chucking jaws 138*d* and 138*d'*, so that the opposite ends of the spring material 2 are chucked between the mandrels 132 and 132' and the spring material fixing units 138 and 138'.

In this manner, after the opposite ends of the spring material 2 are chucked between the mandrels 132 and 132' and the spring material fixing units 138 and 138', the forward and backward transfer units 12 and 12' further transfer the coilers 13 and 13' and the guides 14 and 14' toward the middle part of the base frame 10, and then the coilers 13 and 13' and the guides 14 and 14' are operated so as to correspond to the diameter and pitch of the spring to be manufactured. Thereby, the opposite sides of the spring material 2 are simultaneously coiled around the mandrels 132 and 132'.

In other words, the forward and backward transfer motors 120 and 120' of the forward and backward transfer units 12 and 12' are driven to rotate the ball screws 121 and 121', so that the forward and backward transfer plates 122 and 122', screwed to the ball screws 121 and 121', are further transferred along the ball screws 121 and 121' toward the middle part of the base frame 10. Thus, the coilers 13 and 13' and the guides 14 and 14', which are installed on the upper surfaces of the forward and backward transfer plates 122 and 122', are further transferred toward the middle part of the base frame 10 in cooperation with the forward and backward transfer plates 122 and 122'.

As described above, the coilers 13 and 13' and the guides 14 and 14' are further transferred toward the middle part of the base frame 10 in cooperation with the forward and backward transfer plates 122 and 122', and simultaneously, the mandrel rotating units 136 and 136' are operated to rotate the lower ball spline shafts 131 and 131', so that the mandrels 132 and 132' are rotated to coil the opposite sides of the spring material 2 at the same time. At this time, the pitch adjusting units 135 and 135' are operated to transfer the upper ball spline shafts 133 and 133', the lower ball spline shafts 131 and 131', and the spring material fixing units 138 and 138' toward the second or first side of the base frame 10, so that the coilers 13 and 13' adjust the pitch of the spring material 2 coiled around the mandrels 132 and 132'.

In detail, the spindle rotating motors 136*c* and 136*c'* of the mandrel rotating units 136 and 136' are driven to transmit the rotating force thereof to the timing pulleys 136*a* and 136*a'* through the timing belts 136*b* and 136*b'*, thereby rotating the lower ball spline shafts 131 and 131' and the mandrels 132 and 132'. Thus, the opposite sides of the spring material 2 are coiled around the mandrels 132 and 132' at the same time. Further, the pitch adjusting motors 135*b* and 135*b'* of the pitch adjusting units 135 and 135' are driven to rotate the ball screws 135*a* and 135*a'*, so that the guide blocks 135*c* and 135*c'* move along the ball screws 135*a* and 135*a'* toward the second or first side of the base frame 10. Thereby, the lower ball spline shafts 131 and 131', the first ends of which are fixed to the upper ends of the guide blocks 135*c* and 135*c'*, move toward the second or first side of the base frame 10 in cooperation with the guide blocks 135*c* and 135*c'*. As the lower ball spline shafts 131 and 131' move, the spring material fixing units 138 and 138' and the stationary blocks 137*a* and 137*a'* are also transferred by the lower ball spline shafts 131 and 131'. Thus, the upper ball spline shafts 133 and 133' also cooperate with the lower ball spline shafts 131 and 131', and thus move toward the second or first side of the base frame 10. As a result, the pitch of the spring material 2, coiled around the mandrels 132 and 132', is adjusted.

As described above, the upper ball spline shafts 133 and 133', the lower ball spline shafts 131 and 131', and the spring material fixing units 138 and 138' are transferred toward the second or first side of the base frame 10, so that the pitch of the spring material 2, coiled around the mandrels 132 and 132', is adjusted, and simultaneously, the leftward and rightward transfer blocks 143 and 143' are operated by the pitch adjusting cylinders 144 and 144', and thus the guide rollers 148 and 148' supporting the spring material 2 move toward the second or first side of the base frame 10, so that the guides 14 and 14' adjust the pitch of the spring material 2 coiled around the mandrels 132 and 132'. At this time, the spring diameter adjusting cylinders 149 and 149' are operated to move the guide rollers 148 and 148' in upward and downward directions, so that the guides 14 and 14' adjust the diameter of the spring material 2 coiled around the mandrels 132 and 132'.

At this time, in the case where the spring to be manufactured has a shape in which the opposite sides thereof are curved in opposite directions, i.e. a barrel shape, the coilers 13 and 13' and the guides 14 and 14' are operated to coil the opposite sides of the spring material at the same time, as described above. At this time, the machine frame rotating units 15 and 15' are operated to cause the machine frames 11 and 11' to be simultaneously rotated around the hinges 100 and 100' in one direction. Thereby, the coilers 13 and 13' and the guides 14 and 14' can be rotated in one direction, and coil the opposite sides of the spring material 2 at the same time.

In other words, the rotating motors 153 and 153' of the machine frame rotating units 15 and 15' are driven to rotate the ball screws 151 and 151', so that the movable blocks 152 and 152' move along the ball screws 151 and 151', thereby rotating the machine frames 11 and 11' around the hinges 100 and 100' in one direction. Thus, the coilers 13 and 13' and the guides 14 and 14' can be rotated in one direction, and can coil the opposite sides of the spring material 2 at the same time.

As described above, after the coilers 13 and 13' and the guides 14 and 14' are operated to simultaneously coil the opposite sides of the spring material 2 around the mandrels 132 and 132' so as to correspond to the diameter and pitch of the spring to be manufactured, the spacing adjusting cylinders 137*c* and 137*c'* of the mandrel spacing adjusting units 137 and 137' and the pitch adjusting motors 135*b* and 135*b'* are operated to cause the mandrels 132 and 132' to escape from the spring material 2, the opposite sides of which have been coiled. Then, the middle part of the spring material 2, the opposite sides of which have been coiled, is pressed by the bending press 4, thereby machining the spring to be manufactured in a desired shape.

The spring, machined as described above, is lifted by a spring transfer device 5, and then the opposite ends thereof are pressed by the end forming cylinders 137*d* and 137*d'*. Thereby, the manufacturing of the barrel coil spring is completed.

In the drawings and specification, typical exemplary embodiments of the invention have been disclosed, and although specific terms are employed, they are used in a generic and descriptive sense only and are not for the purposes of limitation, the scope of the invention being set forth in the following claims.

The invention claimed is:

1. An apparatus for manufacturing a barrel coil spring, comprising:

a pair of machine frames (11 and 11'), which are installed on rear and front sides of an upper surface of a base frame (10), and include linear motion guides (110 and 110') installed on opposite sides of upper surfaces of the pair of machine frames;

a pair of forward and backward transfer units (12 and 12') installed on the upper surfaces of the machine frames (11 and 11') such that first sides thereof are coupled to upper surfaces of the linear motion guides (110 and 110') and such that the first sides thereof move along the linear motion guides (110 and 110') at the same time in opposite directions;

a pair of coilers (13 and 13') installed on upper ends of the forward and backward transfer units (12 and 12) and cooperating with the first sides of the forward and backward transfer units (12 and 12') to thereby move from the rear and front sides toward a middle part of the base frame (10), the pair of coilers each being rotatably operated at the same time in opposite directions while moving from a first side toward a second side of the base frame (10), or from the second side toward the first side of the base frame (10) to thereby coil opposite sides of a spring material (2) at the same time; and a pair of guides (14 and 14') installed on the upper surface of the forward and backward transfer units (12 and 12') so as to be located beside the coilers (13 and 13'), supporting the spring material (2), and adjusting pitch and diameter of the spring material (2) coiled by the coilers (13 and 13') while moving in cooperation with the coilers (13 and 13').

2. The apparatus as set forth in claim 1, wherein the pair of machine frames (11 and 11') is coupled to a pair of hinges (100 and 100') protruding from a middle part of the upper surface of the base frame (10) at first ends of first sides thereof, is supported on upper ends of multiple supports (101 and 101') installed on opposite sides of the upper surface of the base frame (10) on lower surfaces of second sides thereof, and is rotated around the hinges (100 and 100').

3. The apparatus as set forth in claim 2, wherein the pair of machine frames (11 and 11') is rotated around the hinges (100 and 100') by operation of machine frame rotating units (15 and 15'), which are coupled to the middle part of the upper surface of the base frame (10) at first ends thereof and to middle parts of lower surfaces of the machine frames (11 and 11') at second ends thereof.

4. The apparatus as set forth in claim 3, wherein the machine frame rotating units (15 and 15') comprise:

stationary blocks (150 and 150'), which are installed on the middle part of the upper surface of the base frame;

rotating motors (153 and 153'), which are hinged to first sides of the stationary blocks (150 and 150'), ball screws (151 and 151'), which are coupled with the rotating motors (153 and 153') at first ends thereof, and are rotated by operation of the rotating motors (153 and 153'); and movable blocks (152 and 152'), which are installed on the middle parts of the lower surfaces of the machine frames (11 and 11'), are screwed to ball screws (151 and 151'), and move along the ball screws (151 and 151').

5. The apparatus as set forth in claim 4, wherein the pair of forward and backward transfer units (12 and 12') comprises: forward and backward transfer motors (120 and 120'), which are installed on the middle parts of the upper surfaces of the machine frames (11 and 11'); ball screws (121 and 121'), which are coupled with the forward and backward transfer motors (120 and 120') at first ends thereof, and are rotated by the forward and backward transfer motors (120 and 120'); and forward and backward transfer plates (122 and 122'), which are installed on the upper surfaces of the linear motion guides (110 and 110') such that lower ends thereof are coupled with second ends of the ball screws (121 and 121'), and move along the linear motion guides (110 and 110') while the ball screws (121 and 121') are rotated.

6. The apparatus as set forth in claim 4, wherein the pair of coilers (13 and 13') comprises:

lower ball spline shafts (131 and 131'), which are rotatably fitted into upper ends of bearing blocks (130 and 130') installed on the upper surfaces of the forward and backward transfer units (12 and 12');

mandrels (132 and 132'), which are fitted around first ends of the lower ball spline shafts (131 and 131') at second ends thereof;

upper ball spline shafts (133 and 133'), which are slidably fastened to middle parts of stationary blocks (139 and 139') installed on upper ends of cases (134 and 134') so as to be located above the lower ball spline shafts (131 and 131');

pitch adjusting units (135 and 135'), which are rotatably fitted into lower ends of the bearing blocks (130 and 130') at first ends thereof, are fixed to the cases (134 and 134') installed on the upper surfaces of the forward and backward transfer units (12 and 12') at the second ends thereof, and are coupled with second ends of the lower ball spline shafts (131 and 131') at middle parts thereof;

mandrel rotating units (136 and 136'), which are installed on the upper surfaces of the forward and backward transfer units (12 and 12'), are coupled with middle parts of the lower ball spline shafts (131 and 131') at first ends thereof, and rotate the lower ball spline shafts (131 and 131') and the mandrels (132 and 132');

mandrel spacing adjusting units (137 and 137'), which are coupled with first ends of the upper ball spline shafts (133 and 133') at first ends thereof, and are installed on second ends of the upper ball spline shafts (133 and 133') so as to be coupled with the second ends of the mandrels (132 and 132') below second ends thereof; and spring material fixing units (138 and 138'), which are installed below the first ends of the mandrel spacing adjusting units (137 and 137') so as to allow the first ends of the mandrels (132 and 132') to be inserted thereinto and coupled thereto.

7. The apparatus as set forth in claim 6, wherein the pitch adjusting units (135 and

135') comprise: ball screws (135*a* and 135*a'*), which are rotatably fitted into lower ends of the bearing blocks (130 and 130') at first ends thereof;

pitch adjusting motors (135*b* and 135*b'*), which are coupled with second ends of the ball screws (135*a* and 135*a'*) so as to rotate the ball screws (135*a* and 135*a'*); and guide blocks (135*c* and 135*c'*), which are screwed to the ball screws (135*a* and 135*a'*) at lower ends thereof, are coupled with the second ends of the lower ball spline shafts (131 and 131') at upper ends thereof, and move along the ball screws (135*a* and 135*a'*) by means of operation of the pitch adjusting motors (135*b* and 135*b'*) to thereby transfer the upper ball spline shafts (133 and 133'), the lower ball spline shafts (131 and 131'), and the mandrels (132 and 132').

8. The apparatus as set forth in claim 6, wherein the mandrel rotating units (136 and

136') comprise: timing pulleys (136*a* and 136*a'*), which are installed on the lower ball spline shafts (131 and 131'); and spindle rotating motors (136*c* and 136*c'*), which are installed on the upper surfaces of the forward and backward transfer units (12 and 12') so as to be coupled with the timing pulleys (136*a* and 136*a'*) through timing belts (136*b* and 135*b'*) and rotate the timing pulleys (136*a* and 136*a'*), the lower ball spline shafts (131 and 131'), and the mandrels (132 and 132').

9. The apparatus as set forth in claim 6, wherein the mandrel spacing adjusting units (137 and 137') comprise: stationary blocks (137*a* and 137*a'*), which are installed on the first ends of the upper ball spline shafts (133 and 133');

movable blocks (137*b* and 137*b'*), which are installed on the upper ball spline shafts (133 and 133') so as to be movable in forward and backward directions, and are coupled to the second ends of the mandrels (132 and 132') at lower ends thereof; and spacing adjusting cylinders (137*c* and 137*c'*), which are coupled to the stationary blocks (137*a* and 137*a'*) at first ends thereof and to the movable blocks (137*b* and 137*b'*) at second ends thereof.

10. The apparatus as set forth in claim 9, wherein the stationary blocks (137*a* and

137*a'*) are equipped with end forming cylinders (137*d* and 137*d'*), on first sides thereof, which form the spring material (2) while pressing ends of the spring material.

11. The apparatus as set forth in claim 6, wherein the spring material fixing units (138 and 138') comprise: bodies (138*a* and 138*a'*), which are installed on lower ends of the stationary blocks (137*a* and 137*a'*) of the mandrel spacing adjusting units (137 and 137');

coupling blocks (138*b* and 138*b'*), which are rotatably installed on first sides of the bodies (138*a* and 138*a'*), and are provided with fastening recesses (1380*b* and 1380*b'*), into and to which the first ends of the mandrels (132 and 132') are inserted and fastened, in middle parts of second sides of the bodies (138*a* and 138*a'*);

chucking cylinders (138*c* and 138*c'*), which are inserted into and mounted in the coupling blocks (138*b* and 138*b'*) such that first ends thereof protrude from middle parts of lower surfaces of the coupling blocks (138*b* and 138*b'*); and chucking jaws (138*d* and 138*d'*), which are mounted on lower ends of the chucking cylinders (138*c* and 138*c'*), and fix the ends of the spring material (2) interposed between the mandrels (132 and 132') and the coupling blocks (138*b* and 138*b'*).

12. The apparatus as set forth in claim 11, wherein the coupling blocks (138*b* and

138*b'*) further include fixing recesses (1381*b* and 1381*b'*) in outer circumferences thereof, and the bodies (138*a* and 138*a'*) are equipped with mandrel stopper cylinders (138*e* and 138*e'*), first ends of which are selectively inserted into the fixing recesses (1381*b* and 1381*b'*), at lower ends thereof.

13. The apparatus as set forth in claim 4, wherein the pair of guides (14 and 14') comprises: linear motion guides (140 and 140'), which are installed on the upper surface of the forward and backward transfer units (12 and 12') so as to be located near first sides of the pair of coilers (13 and 13');

transfer plates (141 and 141'), which are installed on upper surfaces of the linear motion guides (140 and 140'), and move along the linear motion guides (140 and 140');

spring material supports (142 and 142'), which are mounted on first sides of the transfer plates (141 and 141');

spring material loading cylinders (142*a* and 142*a'*), which are installed on the upper surfaces of the forward and backward transfer units (12 and 12') so as to be coupled with middle parts of lower ends of the transfer plates (141 and 141'), and transfer the transfer plates (141 and 141') and the spring material supports (142 and 142') along the linear motion guides (140 and 140');

leftward and rightward transfer blocks (143 and 143'), which are slidably fastened to upper surfaces of the transfer plates (141 and 141') at first sides thereof;

pitch adjusting cylinders (144 and 144'), which are coupled to middle parts of upper surfaces of the transfer plates (141 and 141') at first ends thereof and to second sides of the leftward and rightward transfer blocks (143 and 143') at second ends thereof, and transfer the leftward and rightward transfer blocks (143 and 143');

upward and downward transfer blocks (145 and 145'), which are slidably fastened to upper ends of the second sides of the leftward and rightward transfer blocks (143 and 143');

first rotating shafts (146 and 146'), which are rotatably installed on the upward and downward transfer blocks (145 and 145');

second rotating shafts (147 and 147'), which are rotatably installed on upper ends of the first rotating shafts (146 and 146') at an incline in an upward direction;

guide rollers (148 and 148'), which are rotatably installed on upper ends of the second rotating shafts (147 and 147'); and spring diameter adjusting cylinders (149 and 149'), which are coupled to lower ends of the second sides of the leftward and rightward transfer blocks (143 and 143') at lower ends thereof and to lower ends of the upward and downward transfer blocks (145 and 145') at upper ends thereof.

14. A method for manufacturing a barrel coil spring, comprising:

a spring material loading step of transferring a heated spring material (2) using a loader (3) to load the spring material on guide rollers (148 and 148') of guides (14 and 14') and upper ends of spring material supports (142 and 142');

a spring material fixing step of operating forward and backward transfer units (12 and 12') to move a pair of coilers (13 and 13') and the guides (14 and 14'), which are installed on upper surfaces of forward and backward transfer units (12 and 12'), toward a middle part of a base frame (10) so as to cause opposite ends of the spring material (2) to be inserted between a pair of mandrels (132 and 132') and a pair of spring material fixing units (138 and 138'), and operating chucking cylinders (138*c* and 138*c'*) to lift chucking jaws (138*d* and 138*d'*) so as to cause the opposite ends of the spring material (2) to be fixed between the mandrels (132 and 132') and the spring material fixing units (138 and 138');

a spring material coiling step of rotatably operating the coilers (13 and 13') and the guides (14 and 14') at the same time in opposite directions toward the middle part of the base frame (10) by means of the forward and backward transfer units (12 and 12'), and operating the coilers (13 and 13') and the guides (14 and 14') so as to correspond to a diameter and a pitch of the coil spring to be manufactured to thereby coil opposite sides of the spring material (2) around the mandrels (132 and 132') simultaneously; and a spring material pressing step of operating spacing adjusting cylinders (137*c* and 137*c'*) and pitch adjusting motors (135*b* and 135*b'*) to cause the mandrels (132 and 132') to escape from the spring material (2) whose opposite sides have been coiled, and pressing a middle part of the spring material (2) whose opposite sides have been coiled, using a bending press (4) to machine the coil spring into a desired shape.

15. The method as set forth in claim 14, wherein the spring material coiling step includes operating a pair of machine frame rotating units (15 and 15') to cause the machine frames (11 and 11') to be simultaneously rotated around hinges (100 and 100') in one direction such that the coilers (13 and 13') and the guides (14 and 14') are rotated in one direction to coil the opposite sides of the spring material (2) simultaneously.

16. The method as set forth in claim 15, wherein, in the spring material coiling step, mandrel rotating units (136 and 136') are operated to rotate lower ball spline shafts (131 and 131') and the mandrels (132 and 132') thereby coiling the opposite sides of the spring material (2) around the mandrels (132 and 132') simultaneously, and pitch adjusting units (135 and 135') are operated to transfer upper ball spline shafts (133 and 133'), the lower ball spline shafts (131 and 131'), and the spring material fixing units (138 and 138') toward a second or first side of the base frame (10), so that the coilers (13 and 13') adjust the pitch of the spring material (2) coiled around the mandrels (132 and 132').

17. The method as set forth in claim 15, wherein in the spring material coiling step, leftward and rightward transfer blocks (143 and 143') are operated by pitch adjusting cylinders (144 and 144'), and the guide rollers (148 and 148') supporting the spring material (2) move toward a second or first side of the base frame (10), so that the guides (14 and 14') adjust a pitch of the spring material (2) coiled around the mandrels (132 and 132'), and spring diameter adjusting cylinders (149 and 149') are operated to move the guide rollers (148 and 148') in upward and downward directions, so that the guides (14 and 14') adjust a diameter of the spring material (2) coiled around the mandrels (132 and 132').

* * * * *